US012291880B2

(12) United States Patent
Stefan et al.

(10) Patent No.: US 12,291,880 B2
(45) Date of Patent: May 6, 2025

(54) SCAFFOLDING TRUSS

(71) Applicant: Proscaff Enterprises Inc., Mississauga (CA)

(72) Inventors: Cristian Stefan, Mississauga (CA); Uroš Rožič, Ljubljana (SI)

(73) Assignee: Proscaff Enterprises Inc.

( * ) Notice: Subject to any disclaimer, the term of this patent is extended or adjusted under 35 U.S.C. 154(b) by 927 days.

(21) Appl. No.: 17/408,604

(22) Filed: Aug. 23, 2021

(65) Prior Publication Data

US 2023/0064495 A1 Mar. 2, 2023

(51) Int. Cl.
*E04G 1/14* (2006.01)
*E04G 7/02* (2006.01)

(52) U.S. Cl.
CPC *E04G 1/14* (2013.01); *E04G 7/02* (2013.01)

(58) Field of Classification Search
CPC ..... E04G 1/14; E04G 7/02
See application file for complete search history.

(56) References Cited

U.S. PATENT DOCUMENTS 7,360,341 B2 * 4/2008 Jackson ..... E04G 11/54 52/645
8,479,472 B1 * 7/2013 LeFever ..... E04G 23/0218 52/396.04
8,528,294 B2 * 9/2013 Vanker ..... E04C 3/40 52/270
9,494,273 B2 * 11/2016 Wang ..... F16B 7/18
10,415,262 B2 * 9/2019 Chevis ..... E04G 17/14
10,975,584 B2 * 4/2021 Brownmiller ..... E04G 7/02

FOREIGN PATENT DOCUMENTS

| | | | |
|---|---|---|---|
| CN | 202767483 | | 3/2013 |
| CN | 108952138 | | 12/2018 |
| CN | 108952138 | A * | 12/2018 |
| CN | 12761305 | | 5/2021 |
| JP | 201117230 | A | 1/2011 |
| JP | 2011017230 | | 1/2011 |

(Continued)

OTHER PUBLICATIONS

English translation of CN document (Year: 2018).*

(Continued)

*Primary Examiner* — Kyle R Grabowski
(74) *Attorney, Agent, or Firm* — Rowand LLP

(57) ABSTRACT

A scaffold truss comprising a hollow, rectangular upper horizontal member having vertical side walls and top and bottom walls; a hollow, rectangular lower horizontal member having vertical side walls and top and bottom walls, the lower horizontal member being separated from the upper horizontal member; a plurality of diagonal bracing members to fixedly join the upper horizontal member with the lower horizontal member, each of the plurality of diagonal bracing members forming an X-shape with another diagonal bracing member; and a plurality of vertical members to fixedly join the upper horizontal member with the lower horizontal member; wherein a thickness of the vertical side walls of the horizontal members is greater than a thickness of the top and bottom walls of the horizontal members.

16 Claims, 14 Drawing Sheets

(56) References Cited

FOREIGN PATENT DOCUMENTS

WO 2013005163 1/2013

OTHER PUBLICATIONS

"Technical Data Sheet, Apollo 1500mm X-Beam", Apollo Scaffold Services, https://apolloscaffoldservices.co.uk/pdf/1500xbeam_techsheet.pdf, accessed Aug. 23, 2021.
"Asterix/Asterix HD Brochure", Dessa Limited, https://www.altrad-dessa.com/wp-content/uploads/2018/04/MKT0005-ASTERIX-ASTERIX-HD-EN-1.pdf, accessed Aug. 23, 2021.
"1500mm X-Beam Layout Drawing", Apollo Scaffold Services, https://apolloscaffoldservices.co.uk/pdf/1500xbeamlayout.pdf, accessed Aug. 23, 2021.
CIPO: CA Office Action relating to CA application No. 3,170,963, dated Nov. 1, 2023.
Search Report dated Mar. 16, 2023, United Kingdom Application No. 2212216.2.

* cited by examiner

SCAFFOLDING TRUSS

FIELD

This application relates to scaffold truss assemblies, and more particularly, to assemblies providing optimal layout and maximum strength for their height and width.

BACKGROUND

Scaffolding refers to temporary structures used to support a work crew and to materials to aid in the construction, maintenance and repair of buildings, bridges and other man-made structures. Scaffolds are widely used on site to access heights and areas that would be otherwise hard to reach. Scaffolding is also used in adapted forms for formwork and shoring, grandstand seating, concert stages, access/viewing towers, exhibition stands, ski ramps, half pipes and art projects. Unsafe scaffolding has the potential to result in death or serious injury.

Trusses are commonly used to form bridges on independent scaffolds and to create temporary roof structures. Trusses combine high strength with a low weight and cost, offering an economical solution for the creation of beam spans, crash decks and medium sized temporary roof structures.

Accordingly, it may be desirable to provide a scaffold truss that is compact in size and which optimizes strength and rigidity for the height and weight of the truss.

BRIEF DESCRIPTION OF THE DRAWINGS

Embodiments are described in detail below, with reference to the following drawings.

Like reference numerals are used in the drawings to denote like elements and features.

DETAILED DESCRIPTION OF EXAMPLE EMBODIMENTS

Figure 1:
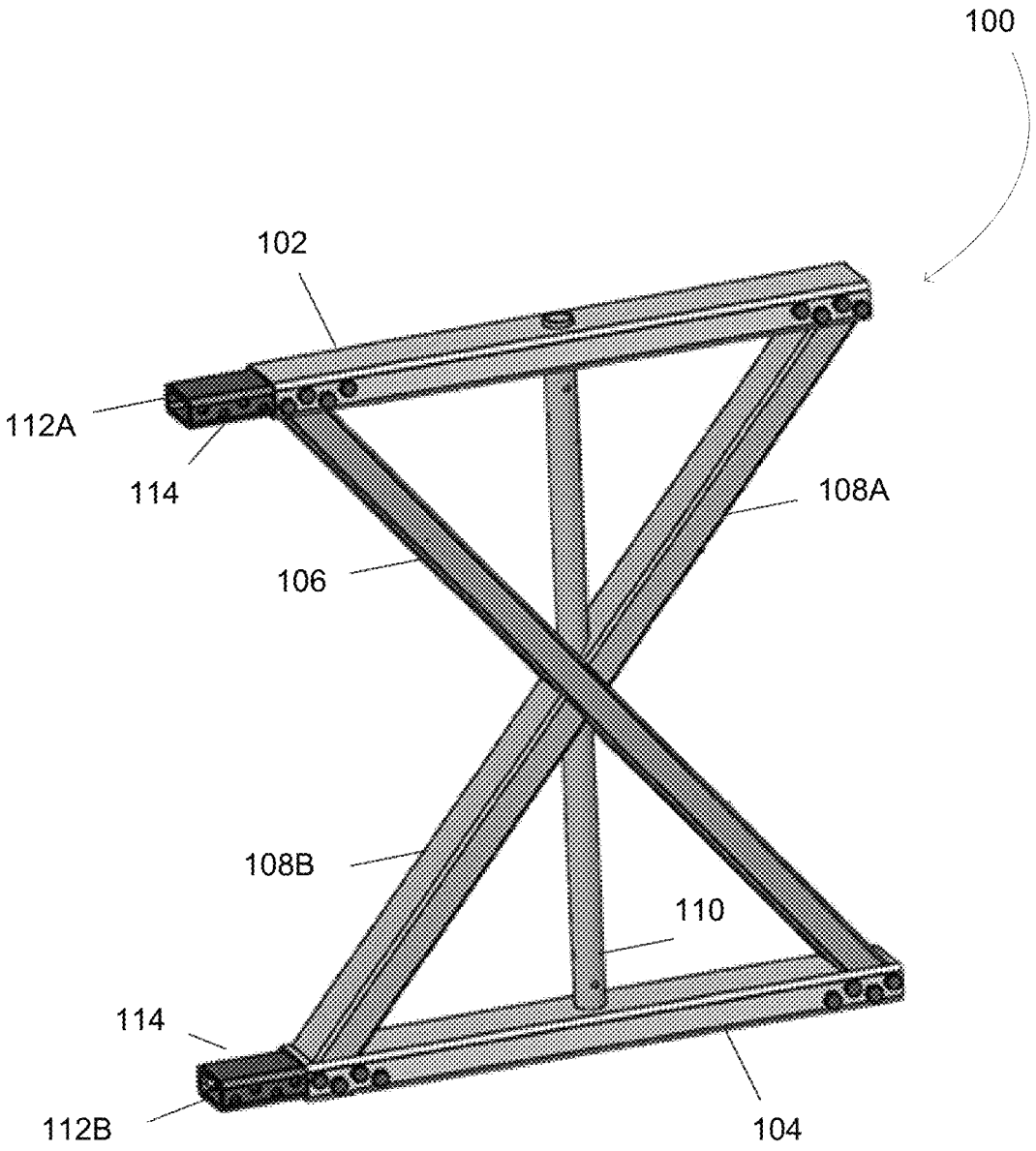
FIG. 1 is a front perspective view of a first scaffold truss, in accordance with an example of the present application.

According to the subject-matter of the present application, there is provided a scaffold truss comprising: a hollow, rectangular upper horizontal member having vertical side walls and top and bottom walls; a hollow, rectangular lower horizontal member having vertical side walls and top and bottom walls, the lower horizontal member being separated from the upper horizontal member; a plurality of diagonal bracing members to fixedly join the upper horizontal member with the lower horizontal member, each of the plurality of diagonal bracing members forming an X-shape with another diagonal bracing member; and a plurality of vertical members to fixedly join the upper horizontal member with the lower horizontal member; wherein a thickness of the vertical side walls of the horizontal members is greater than a thickness of the top and bottom walls of the horizontal members.

In some implementations, an outside corner radius of the horizontal members is greater than the thickness of the vertical side walls of the horizontal members.

In some implementations, the outside corner radius, the thickness of the top and bottom walls, and the thickness of the vertical side walls are unequal.

In some implementations, the thickness of the vertical side walls is 7 mm, the thickness of the top and bottom walls is 5 mm, and the outside corner radius is 10 mm.

In some implementations, the plurality vertical members are circular pipes having a diameter smaller than a lateral width of the diagonal bracing members, and wherein one or more of the plurality of vertical members pass through vertical through holes in the diagonal bracing members.

In some implementations, the vertical members are fixedly joined to the upper horizontal member and to the lower horizontal member at a fixed spacing interval and wherein the fixed spacing interval the vertical members is less than a horizontal span of the X-shape.

In some implementations, the scaffold truss has first and second ends; the fixed spacing interval is 1 m; and one of the vertical members is fixedly joined to the horizontal members at a distance of 0.5 m from a first end of the scaffold truss.

In some implementations, the diagonal bracing members are fixedly connected to one another.

In some implementations, the horizontal members and the plurality of diagonal bracing members are made of extruded aluminum and have engineered rectangular profiles.

In some implementations, the plurality of diagonal bracing members are fixedly joined to the upper horizontal member and to the lower horizontal member.

In some implementations, the plurality of diagonal bracing members are hollow, have equal wall thicknesses of 3 mm, have an inside radius of 3 mm and have an outside radius of 6 mm.

In some implementations, the plurality of diagonal bracing members are fixedly joined to the upper horizontal member and to the lower horizontal member at an acute angle of about 35 degrees to 39 degrees.

In some implementations, the plurality of vertical members are made of steel.

In some implementations, the vertical members have first and second ends, the first and second ends being configured to removably connect with a spigot clamp.

In some implementations, the horizontal members have first and second ends, the first and second ends being configured to removably connect with a coupling pin.

In some implementations, the upper horizontal member and the lower horizontal member have first and second ends having bolt holes positioned in a staggered pattern.

In some implementations, the horizontal members have a length selected from the group consisting of 1 m, 3 m and 5 m.

In some implementations, the vertical members are hollow and have a wall thickness of 2.5 mm.

According to the subject-matter of the present application, there is provided a coupling pin adapted to connect a first scaffold truss to a second scaffold truss, the coupling pin comprising: a hollow rectangular tube having rounded walls, the hollow rectangular tube comprising: two long sides and two short sides, the two short sides having bolt holes positioned in a staggered pattern, wherein the hollow rectangular tube has a corner radius that is greater than a thickness of the short sides and that is greater than a thickness of the long sides.

In some implementations, the corner radius is 10 mm and the thickness of the short sides and the thickness of the long sides is 8 mm.

In some implementations, the coupling pin is made of steel.

Other aspects and features of the present application will be understood by those of ordinary skill in the art from a review of the following description of examples in conjunction with the accompanying figures.

In the present application, the term "and/or" is intended to cover all possible combinations and sub-combinations of the listed elements, including any one of the listed elements alone, any sub-combination, or all of the elements, and without necessarily excluding additional elements.

In the present application, the phrase "at least one of . . . or . . . " is intended to cover any one or more of the listed elements, including any one of the listed elements alone, any sub-combination, or all of the elements, without necessarily excluding any additional elements, and without necessarily requiring all of the elements.

In order to transport one or more trusses from one location to another, a high cube sea freight container may be used. The International Organization for Standardization (ISO) has defined the door height of a high cube shipping container to be 2.57 m. As a result, in order to be able to stack a pair of trusses within these containers, each truss must have a maximum height of approximately 1.25 m.

At present, a commercially available scaffold truss may have an overall height of 1.5 m, and therefore an overall height of 3.0 m when two of these trusses are stacked one upon the other. As a result, the commercially available scaffold truss will not stack within a high cube sea freight container. In contrast, some embodiments of the present application provide a scaffold truss of a height of 1.19 m, resulting in a total height of 2.38 m when two trusses are stacked. As a result, multiple scaffold trusses of the present application may be stacked upon each other within a high cube shipping container, maximizing the available space and minimizing shipping costs.

An issue with reducing the height of the truss as compared to existing scaffold trusses is that the resulting truss would have a lower load bearing capacity. Accordingly, the present application provides for a new truss design and configuration that in some implementations allows for reduced height whilst still providing as good or better load bearing capacity than existing scaffold trusses. In some embodiments, the width of the diagonal bracing members is greater than half the width of the horizontal members, which may provide increased strength as compared with some existing trusses.

Reference is made to FIG. 1, which illustrates a perspective view of a first scaffold truss 100 in accordance with an example of the present application. The first scaffold truss 100 in this example has a total length of 1 m. The first scaffold truss 100 includes a hollow, rectangular, upper horizontal member 102 parallel to and spaced apart from a hollow, rectangular, lower horizontal member 104. The upper horizontal member 102 is fixedly joined to lower horizontal member 104 by the diagonal bracing members 106, 108. Upper horizontal member 102 and lower horizontal member 104 have first and second ends having bolt holes oriented in a staggered position. The first diagonal bracing member 106 is a full diagonal bracing member, and the diagonal bracing member 108 is formed from two elements, 108A and 108B. As shown, the diagonal bracing member elements 108A, 108B are fixedly connected at the centre of first diagonal bracing member 106 to form an X-shape. In some embodiments, each of the diagonal bracing members 106, 108 are positioned such that they form an acute angle with one of the horizontal members 102, 104 of about 35-39 degrees. In some embodiments, the acute angle formed ranges from 37-38 degrees. In some embodiments, the acute angle formed is about 37.5 degrees and in at least one embodiment, the acute angle formed is 37.54 degrees.

It will be noted that the diagonal bracing members 106, 108 have a width as wide or nearly as wide as the width of the horizontal members 102, 104, thereby providing the first scaffold truss 100 with greater lateral strength and stability as compared to an implementation in which the diagonal bracing members are less than half the width of the horizontal members. It will also be appreciated that the diagonal bracing members 106, 108, are substantially in tension and/or compression when in use under load on the truss.

As shown in the example, the first scaffold truss 100 further includes a vertical member 110. The vertical member 110 is installed between the upper horizontal member 102 and the lower horizontal member 104 and, in this example, passes through the diagonal bracing members 106 and 108. The diameter of the vertical member 110 is narrower than the lateral width of the upper horizontal member 102 and the lower horizontal member 104 and the width of the diagonal bracing members 106, 108. The vertical member 110 is less significant than the diagonal bracing members 106, 108 for load bearing capacity of the first scaffold truss 100 and instead serves as an anchor point for attachment of bracing between laterally adjacent trusses, and to support spigot or other attachments atop the first scaffold truss 100, for instance to enable the installation of decking above the first scaffold truss 100.

In embodiments having a length of 1 m, the vertical member 110 may be installed at the midpoints of the upper and lower horizontal members 102, 104, i.e. passing through approximately the center of the X-shape. This enables the construction of truss structures using a series of the trusses 100 that result in vertical members 110 spaced at least every 1 m along the truss structure.

The first scaffold truss 100 is shown having connectors, i.e., couplings 112A, 112B attached. As shown in FIG. 1, the couplings 112A and 112B may have bolt holes 114 oriented in a staggered position which compliment the pattern of the bolt holes in the first and second horizontal members, 102 and 104. In some embodiments, as shown, the first scaffold truss 100 may be fixedly connected to the couplings 112A and 112B using bolts 116, which may be M16 bolts of grade 8.8, in some implementations.

The horizontal members 102, 104, and the diagonal bracing members 106, 108, may be formed from extruded aluminum in some implementations. In other implementations, a metal other than aluminum may be selected based on its combination of low cost, light weight, and strength. In some implementations, non-metal engineered products may be used.

As will be described later below, the horizontal members 102, 104 and the bracing members 106, 108 are formed as engineered products having selected profiles and wall thicknesses that provide for sufficient strength and stability while ensuring low cost and weight. Moreover, the first scaffold truss 100 dimensions and the dimensions and profiles of the horizontal members 102, 104 and the diagonal bracing members 106, 108 may be selected so as to achieve an improved load bearing capacity versus existing trusses, while resulting in a lower height that enables more compact packaging and shipping of the trusses 100. In some instances, the truss height is constrained during design to enable the trusses to be optimally stacked within standard shipping containers to improve the efficiency of shipping and delivery of the trusses 100.

Figure 2:
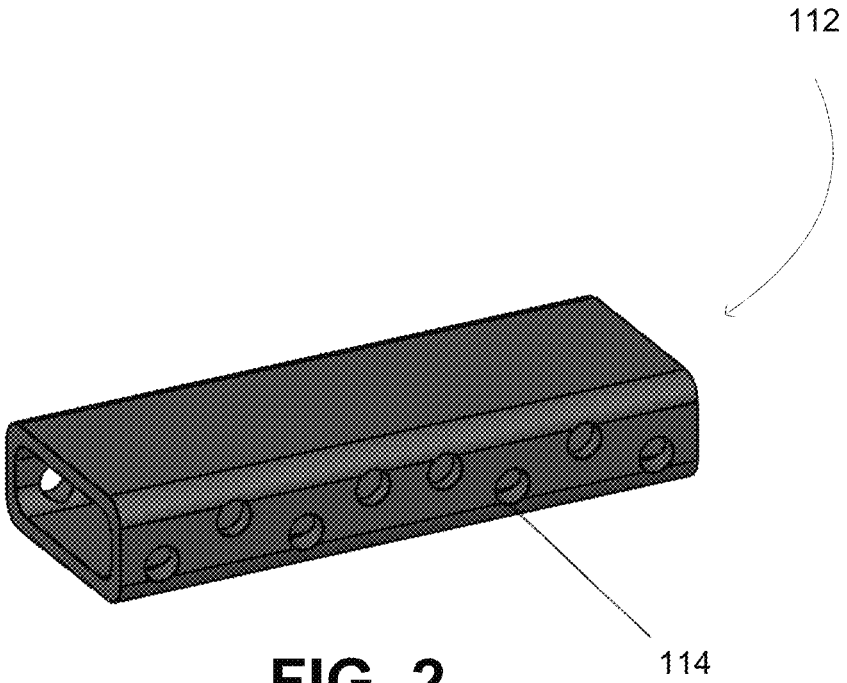
FIG. 2 is a front perspective view of a coupling, in accordance with an example of the present application.

FIG. 2 illustrates a front, perspective view of the scaffold truss assembly coupling 112, in accordance with an example of the present application. FIG. 2 illustrates the staggered placement of bolt holes 114.

Figure 3:
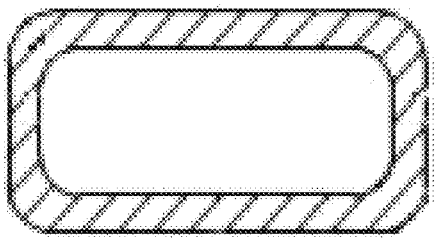
FIG. 3 is a cross-sectional view of the coupling of FIG. 2, in accordance with an example of the present application.

FIG. 3 illustrates a cross-sectional view of the coupling 112, in accordance with an example of the present application. In this example, the walls of the coupling have a consistent thickness of 8 mm, and the corner radii are each 10 mm. The coupling 112 may be formed from steel and have rounded walls.

Figure 4:
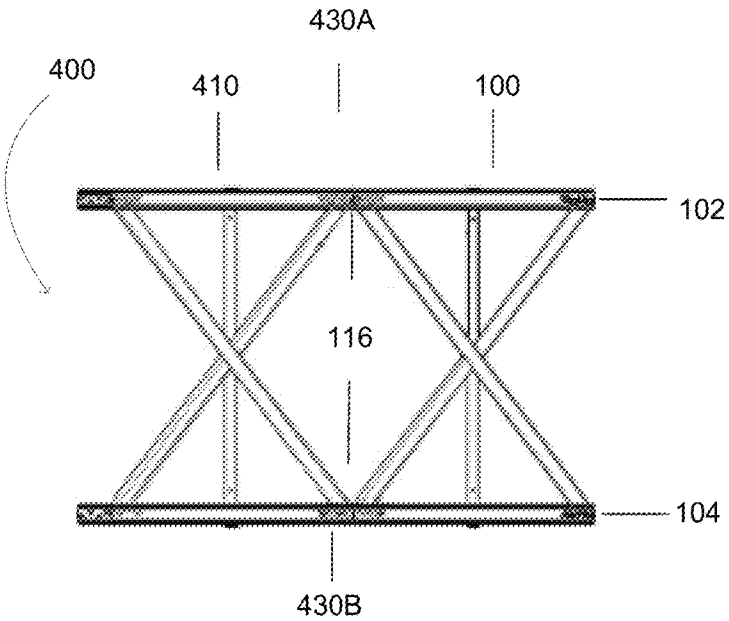
FIG. 4 a front view of a first scaffold truss assembly, in accordance with an example of the present application.

FIG. 4 illustrates an example embodiment of a first scaffold truss assembly 400. As shown, the first scaffold truss 100 is fixedly connected to a first partner scaffold truss 410 at connections 430A and 430B via couplings 112A and 112B (not shown). In some embodiments, the first partner scaffold truss 410 may be identical to the first scaffold truss 100. The coupling 112A is provided within a first end of the upper horizontal member 102 of the first scaffold truss 100 and is provided within a first end of the upper horizontal member of first partner scaffold truss 410. The coupling 112B is provided within a first end of the lower horizontal member 104 of the first scaffold truss 100 and is provided within a first end of the lower horizontal member of the first partner scaffold truss 410. The couplings 112A and 112B may be fixedly connected to the horizontal members using bolts 116, for example.

Figure 5:
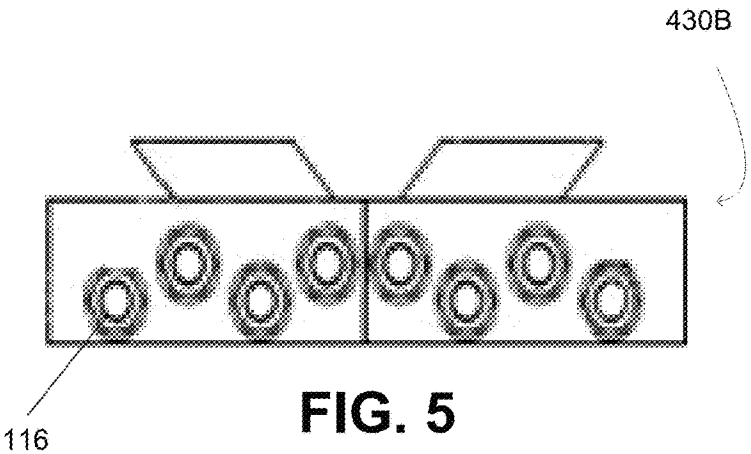
FIG. 5 is a front view of a connection of the first scaffold truss assembly, in accordance with one example of the present application.

FIG. 5 illustrates a side view of the connection 430B of the first scaffold truss assembly 400. In this example, the bolts 116 are arranged in a staggered position and provide added strength to the first scaffold truss assembly 400. In some embodiments, the bolts may be M16 bolts having grade 8.8.

Figure 6:
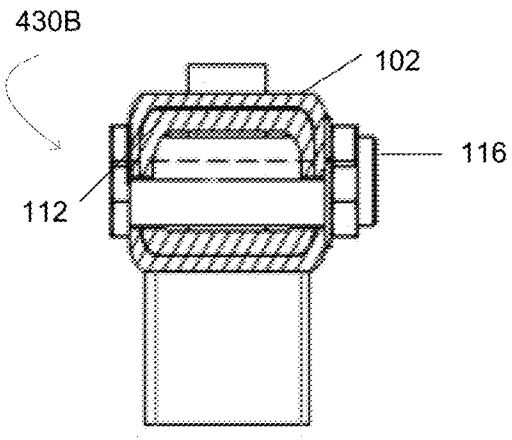
FIG. 6 is a side, cross-sectional view of a connection of the first scaffold truss assembly, in accordance with an example of the present application.

FIG. 6 illustrates a cross-sectional view the connection 430A. The coupling 112 is shown within the first end of the upper horizontal member 102. One of the bolts 116 is illustrated fixedly connected through the coupling 112 and the upper horizontal member 102.

Figure 7:
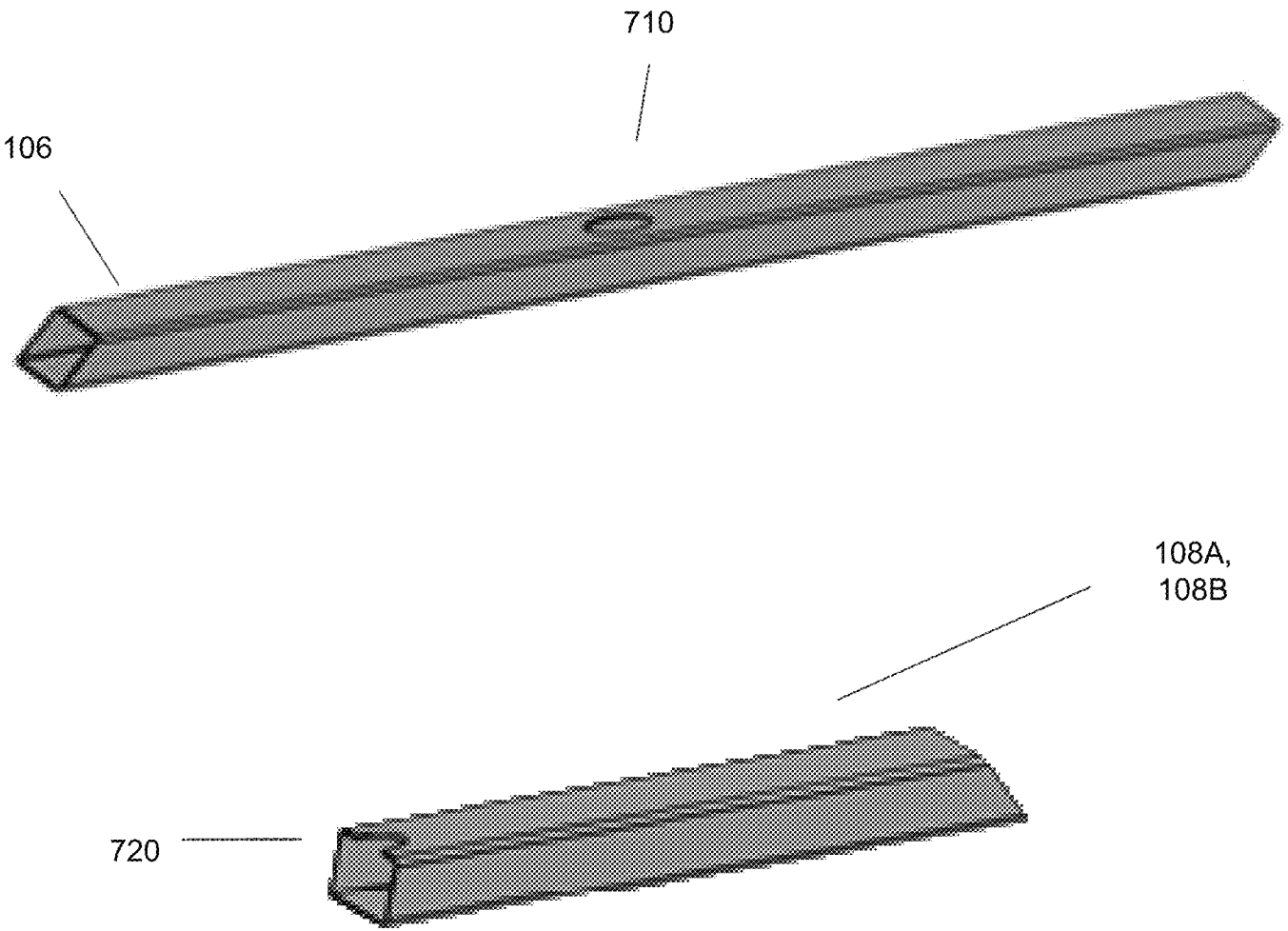
FIG. 7 is a perspective view of a first diagonal bracing member and a perspective view of a first diagonal bracing member element, in accordance with one example of the present application.

FIG. 7 illustrates a perspective view of the first diagonal bracing member 106, the first diagonal bracing member element 108A and the second diagonal bracing member element 108B in accordance with an example of the present application. As shown, a second diagonal bracing member 108 comprises two identical diagonal bracing member elements 108A and 108B, which may be fixedly attached, e.g. welded, at the centre of to provide the streamlined X-shape shown in FIG. 1. The diagonal bracing member elements 108A, 108B may be fixedly attached to first diagonal bracing member 106 through welding, for example.

As illustrated, the diagonal bracing member 106 has a vertical through hole 710 to provide for the passage of vertical member 110 in construction of the X-shape shown in FIG. 1. In some embodiments, the vertical member 110 may be positioned at a horizontal distance of about 0.5 m from one or both ends of the first scaffold truss 100, i.e. at approximately the middle of the first diagonal bracing member 106. The diagonal bracing member elements 108A, 108B may include a notch 720 to provide for the passage of the vertical member 110 through the X-shape when the diagonal bracing member elements 108A,108B are connected to the first diagonal bracing member 106. It will be appreciated, that the angle of the through hole 710 and the notches 720 is formed such that when the first diagonal bracing member 106 and the diagonal bracing member elements 108A,108B are assembled to form the X-shape, the through hole 710 and the notches 720 are vertically aligned such that they provide a vertical through hole through which the vertical member 110 passes. In some embodiments, the vertical member 110 may be welded to the first diagonal bracing member 106 and the diagonal bracing member elements 108A, 108B once put in place.

In some embodiments, the diagonal bracing members 106, 108 may be made from aluminum with an engineered rectangular profile. In some embodiments, the diagonal bracing members 106, 108 may have equal wall thicknesses of 3 mm, an inside radius of 3 mm and an outside radius of 6 mm.

Figure 8:
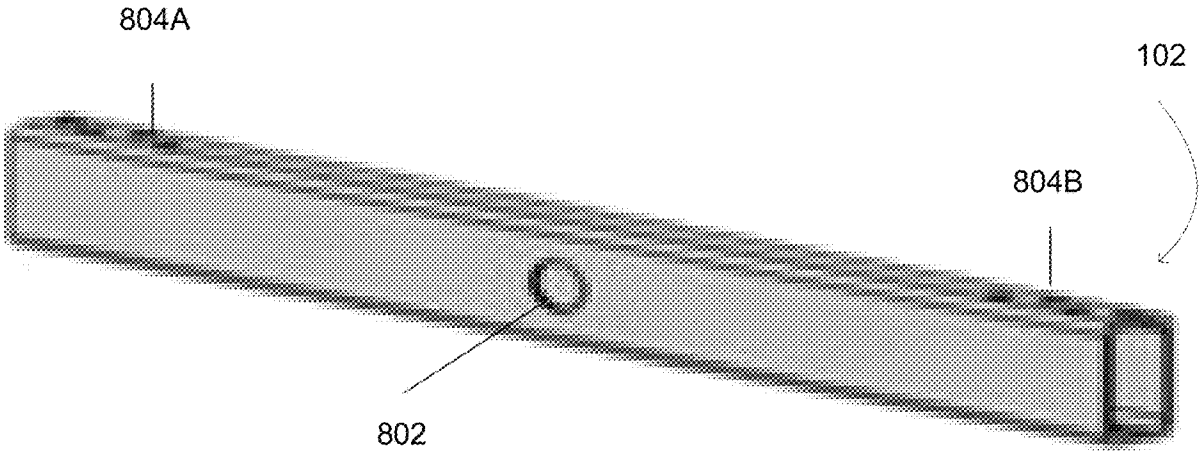
FIG. 8 is a top, perspective view of an upper horizontal bracing member of the first scaffold truss, in accordance with one example of the present application.

FIG. 8 illustrates a top perspective view of upper horizontal member 102, according to an embodiment. As shown in the example, upper horizontal member 102 includes a plurality of offset horizontal member bolt holes 804A, 804B at both ends and an opening 802 midway through the upper horizontal member 102. In some embodiments, the opening 802 is a through hole through which the vertical member 110 passes. In some embodiments, the lower horizontal member 104 has the same form as the upper horizontal member 102. In some implementation, the lower horizontal member 104 may have an opening 802 only on its upper side with a closed lower side such that the vertical member 110 rests on the inside face of the closed lower side when in place. The vertical member 110 may then be welded along the edges of the openings 802 in both the upper horizontal member 102 and the lower horizontal member 104.

Figure 9:
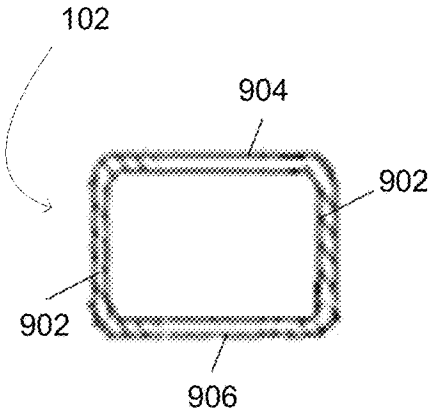
FIG. 9 is a cross-sectional view of the upper horizontal member of FIG. 8, in accordance with one example of the present application.

FIG. 9 shows a cross-sectional view of the upper horizontal member 102, according to some embodiments. In this example, the vertical walls 902 of the coupling have a thickness of 7 mm, the top and bottom walls 904, 906 have a thickness of 5 mm and the corner radii are each 10 mm. In some embodiments, the relative thickness of the vertical walls may provide strength and rigidity to the first scaffold truss 100 and to the first scaffold truss assembly 400. The relative narrowness of the top and bottom walls may reduce the weight of the scaffold truss without compromising the strength and rigidity of the first scaffold truss 100 and the first scaffold truss assembly 400

Figure 10:
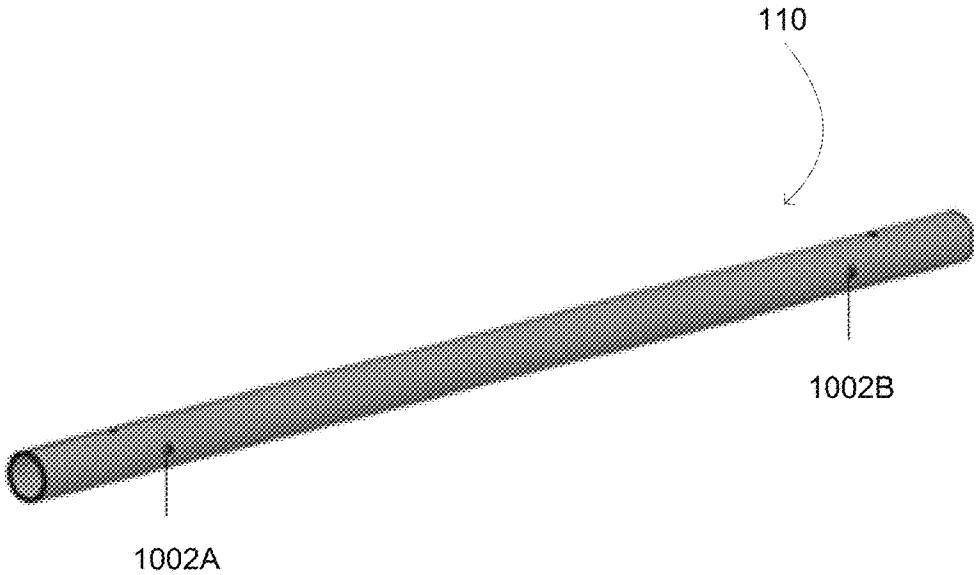
FIG. 10 is a perspective view of a vertical member, in accordance with one example of the present application.

FIG. 10 shows a perspective view of the vertical member 110, in accordance with an embodiment. The vertical member 110 is a circular tube in this implementation. In this example, the wall of the vertical member 110 has a thickness of 2.5 mm, and connection pin holes 1002 may be included to allow for the attachment of scaffold truss accessories (not shown).

Figure 11:
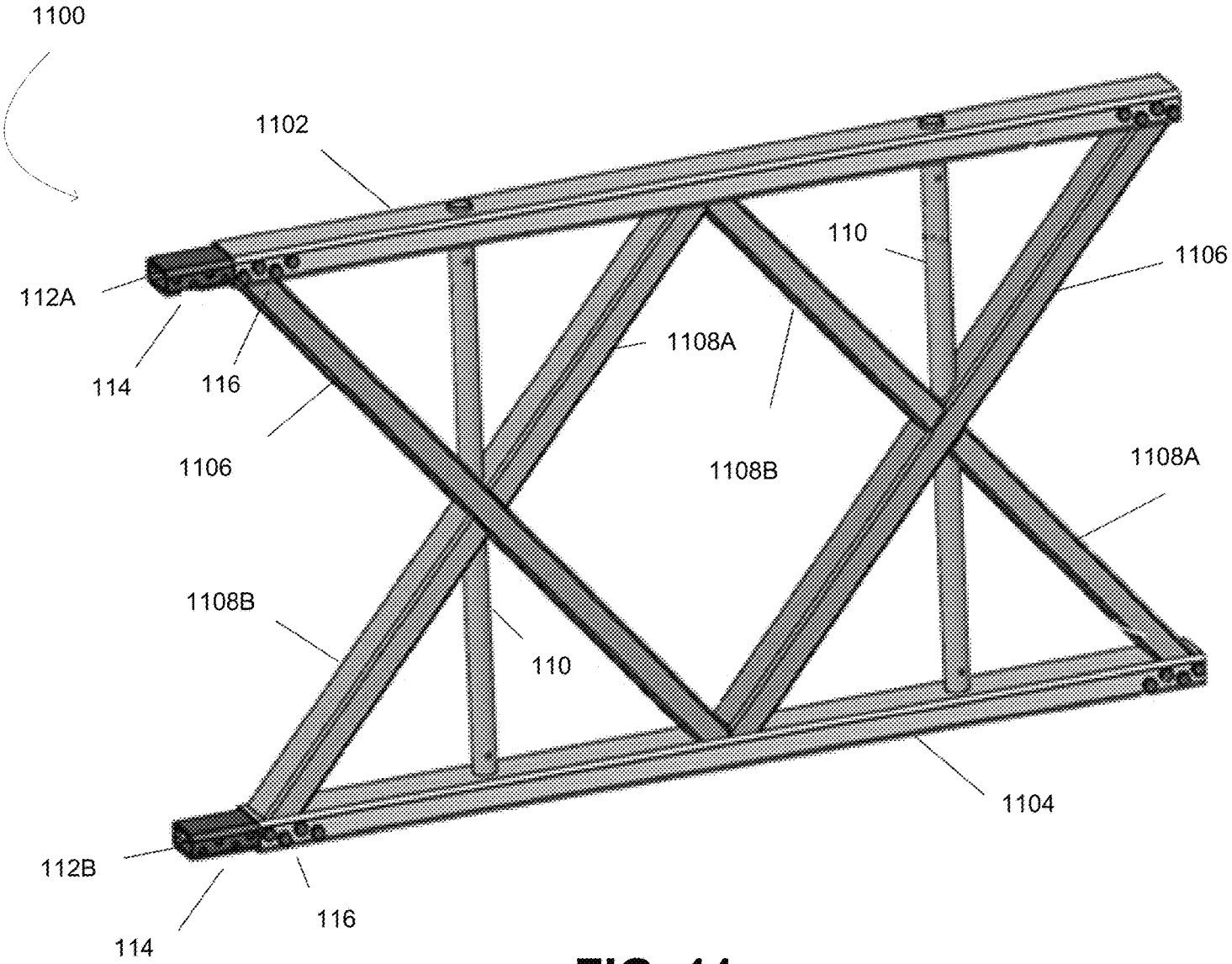
FIG. 11 is a front, perspective view of a second scaffold truss, in accordance with one example of the present application.

FIG. 11 illustrates a perspective view of a second scaffold truss 1100 in accordance with an example of the present application. In this example, the second scaffold truss 1100 has a total length of 2 m. The second scaffold truss 1100 includes hollow, rectangular, upper horizontal member 1102 parallel to and spaced apart from hollow, rectangular, lower horizontal member 1104. Upper horizontal member 1102 is fixedly joined to lower horizontal member 1104 by diagonal bracing members 1106, 1108 and two vertical members 110. Upper horizontal member 1102 and lower horizontal member 1104 have first and second ends having bolt holes oriented in a staggered position. The diagonal bracing member 1106 is a full diagonal bracing member, and the diagonal bracing member 1108 comprises two elements, 1108A and 1108B. As shown, the diagonal bracing member elements 1108A and 1108B are fixedly connected at the centre of diagonal bracing member 1106 to form an X-shape. In some embodiments, each of the diagonal bracing members 1106, 1108 are positioned such that they form an acute angle with one of the horizontal members 102, 104 of about 35-39 degrees. In some embodiments, the acute angle formed ranges from 37-38 degrees. In some embodiments, the acute angle formed is about 37.5 degrees and in at least one embodiment, the acute angle formed is 37.54 degrees. In some embodiments, the diagonal bracing member 1106 and diagonal bracing member elements 1108A and 1108B are fixedly joined, for example, by welding, where they meet, at the upper horizontal member 1102 and at the lower horizontal member 1104. The fixed joining of these components may provide strength to the second scaffold truss 1100.

In some embodiments, the cross-sectional dimensions of the horizontal members of the second scaffold truss may be identical to the cross-sectional dimensions of the horizontal members of the first scaffold truss. In some embodiments, the cross-sectional dimensions of the diagonal bracing members of the second scaffold truss may be identical to the cross-sectional dimensions of the horizontal members of the first scaffold truss.

As shown in the example, two vertical members 110 are installed between the upper horizontal member 1102 and the lower horizontal member 1104. In the example, the vertical members 110 are installed through the diagonal bracing members 1106 and 1108. As shown, the diameter of the vertical member 110 is narrower than the lateral thickness of the upper horizontal member 1102, the lower horizontal member 1104 and the diagonal bracing members 1106 and 1108. The relative narrowness of vertical member 110 may provide for a profile that provides for space maximization when transporting and/or storing multiple trusses together, for example, within a storage container.

In the illustrated embodiment, the vertical members 110 may be installed along the second scaffold truss 1100 at a distance from one another, for example, at a distance of 1 m. The vertical members 110 may be installed beginning at a distance from an end of the second scaffold truss 1100, for example, at a distance of 0.5 m. The spacing pattern of the vertical members may provide for the installation of the vertical members 110 through the diagonal bracing members 1106 and 1108. The vertical members may provide for one or more spigots (not shown) to be installed at the upper and lower horizontal members 1102, 1104. In some embodiments, a spigot may be placed within the open ends of the vertical members and may be secured with a connection pin.

The second scaffold truss 1100 is shown having connectors, i.e., couplings 112A, 112B attached. As shown, the couplings 112A and 112B may have bolt holes 114 oriented in a staggered pattern which compliments the pattern of the bolt holes in the upper and lower horizontal members 1102, 1104. In some embodiments, as shown, the second scaffold truss 1100 may be fixedly connected to the couplings 112A and 112B using bolts 116, which may be M16 bolts of grade 8.8.

Figure 12:
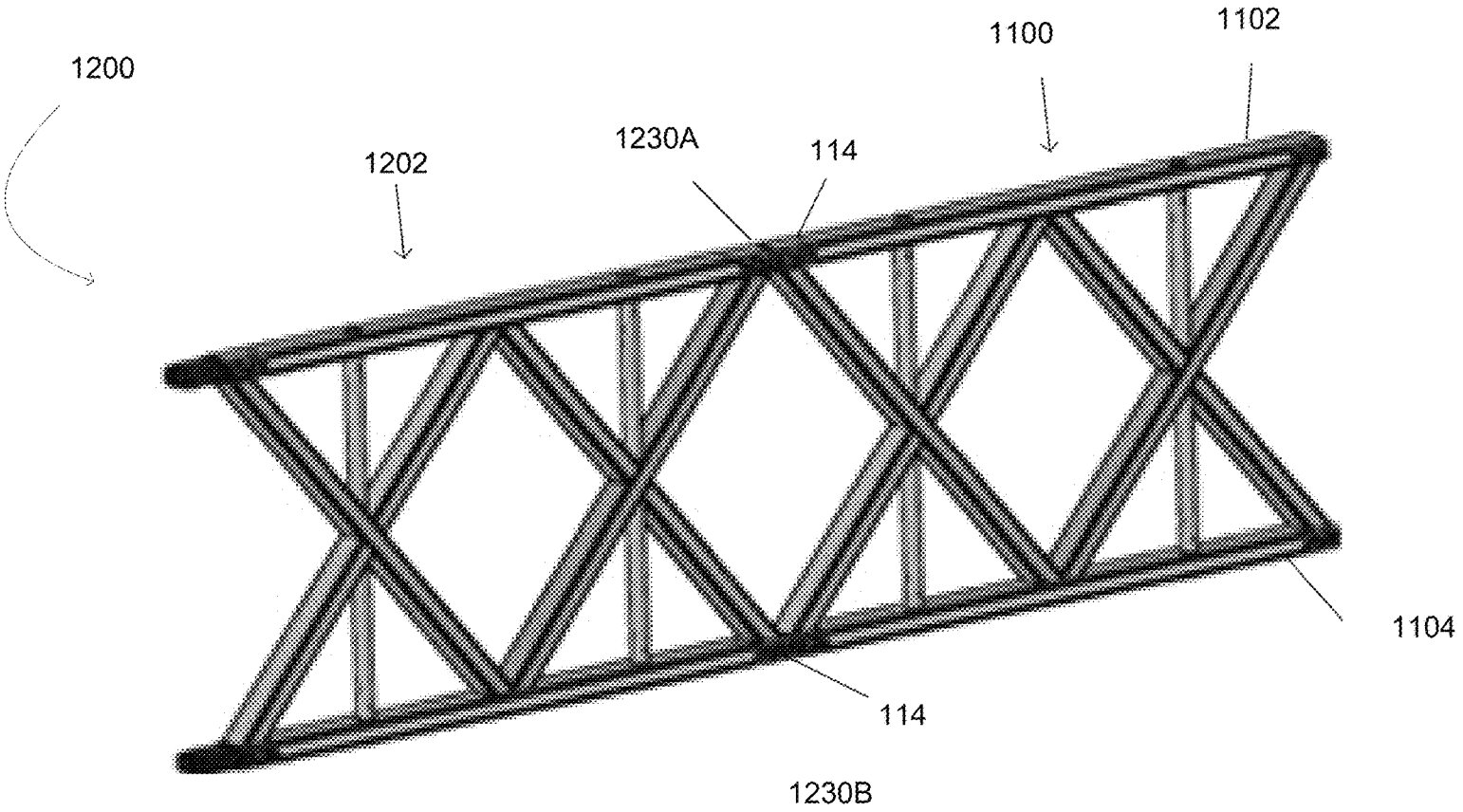
FIG. 12 is a front, perspective view of a second scaffold truss assembly, in accordance with one example of the present application.

FIG. 12 illustrates an example embodiment of a second scaffold truss assembly 1200. In this example, a second scaffold truss 1100 is fixedly connected to a second partner scaffold truss 1202 at connections 1230A and 1230B via couplings 112A and 112B (not shown). The coupling 112A is provided within a first end of the upper horizontal member 1102 of the second scaffold truss 1100 and is provided within a first end of the upper horizontal member of second partner scaffold truss 1202. The coupling 112B is provided within a first end of the lower horizontal member 1104 of the second scaffold truss 1100 and is provided within a first end of the lower horizontal member of second partner scaffold truss 1202. The couplings 112A and 112B are fixedly connected to the horizontal members using bolts 116, for example.

Figure 13:
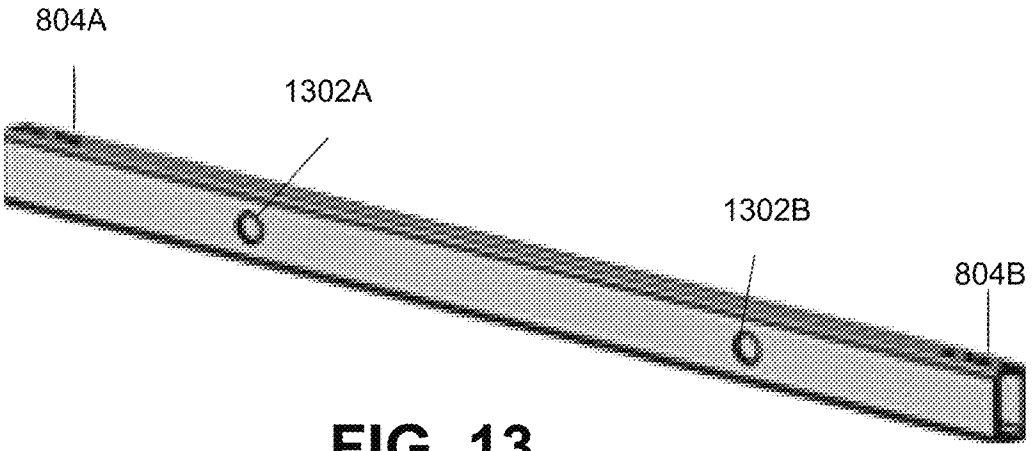
FIG. 13 is a top, perspective view of an upper horizontal bracing member of the second scaffold truss, in accordance with one example of the present application.

FIG. 13 illustrates a top perspective view of upper horizontal member 1102, according to an embodiment. As shown in the example, upper horizontal member 1102 includes horizontal member bolt holes 804A, 804B at both ends and two openings 1302A and 1302B spaced part way through the upper horizontal member 1102. In some embodiments, the openings 1302A and 1302B provide means for fixedly connecting the upper horizontal member with to vertical member 110. In some embodiments where the scaffold truss has a length of 2 m, the lower horizontal member 1104 has the same form as the upper horizontal member 1102.

Figure 14:
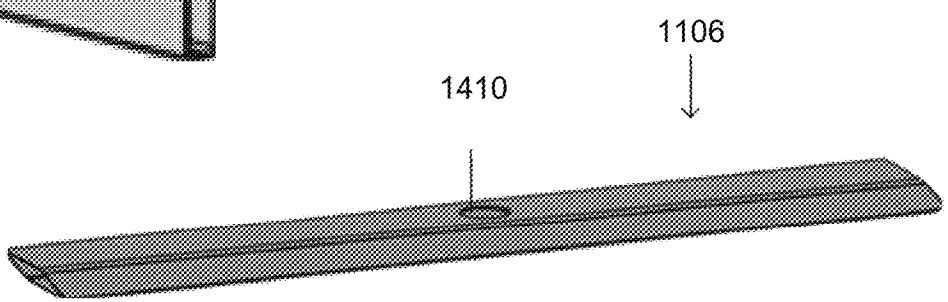
FIG. 14 is a perspective view of a first diagonal bracing member of the second scaffold truss, in accordance with one example of the present application.

FIG. 14 illustrates diagonal bracing member 1106. As illustrated, the diagonal bracing member 1106 has a vertical through hole 1410 to provide for the passage of vertical member 110.

Figure 15:
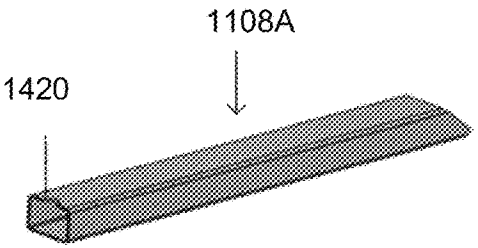
FIG. 15 is a perspective view of a first diagonal bracing member element of the second scaffold truss, in accordance with one example of the present application.

FIG. 15 illustrates first diagonal bracing member element 1108A. As shown, first diagonal bracing member element 1108A includes a small notch 1420 to provide for the passage of vertical member 110.

Figure 16:
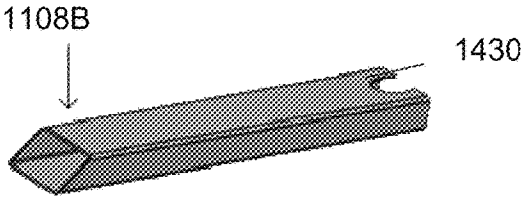
FIG. 16 is a perspective view of a second diagonal bracing member element of the second scaffold truss, in accordance with one example of the present application.

FIG. 16 illustrates second diagonal bracing member element 1108B. As shown, second diagonal bracing member element 1108A has a large notch 1430 to allow for the passage of vertical member 110. In some embodiments, the vertical member 110 may be positioned at a distance from 0.5 m from one or both ends of the second scaffold truss 1100.

Figure 17:
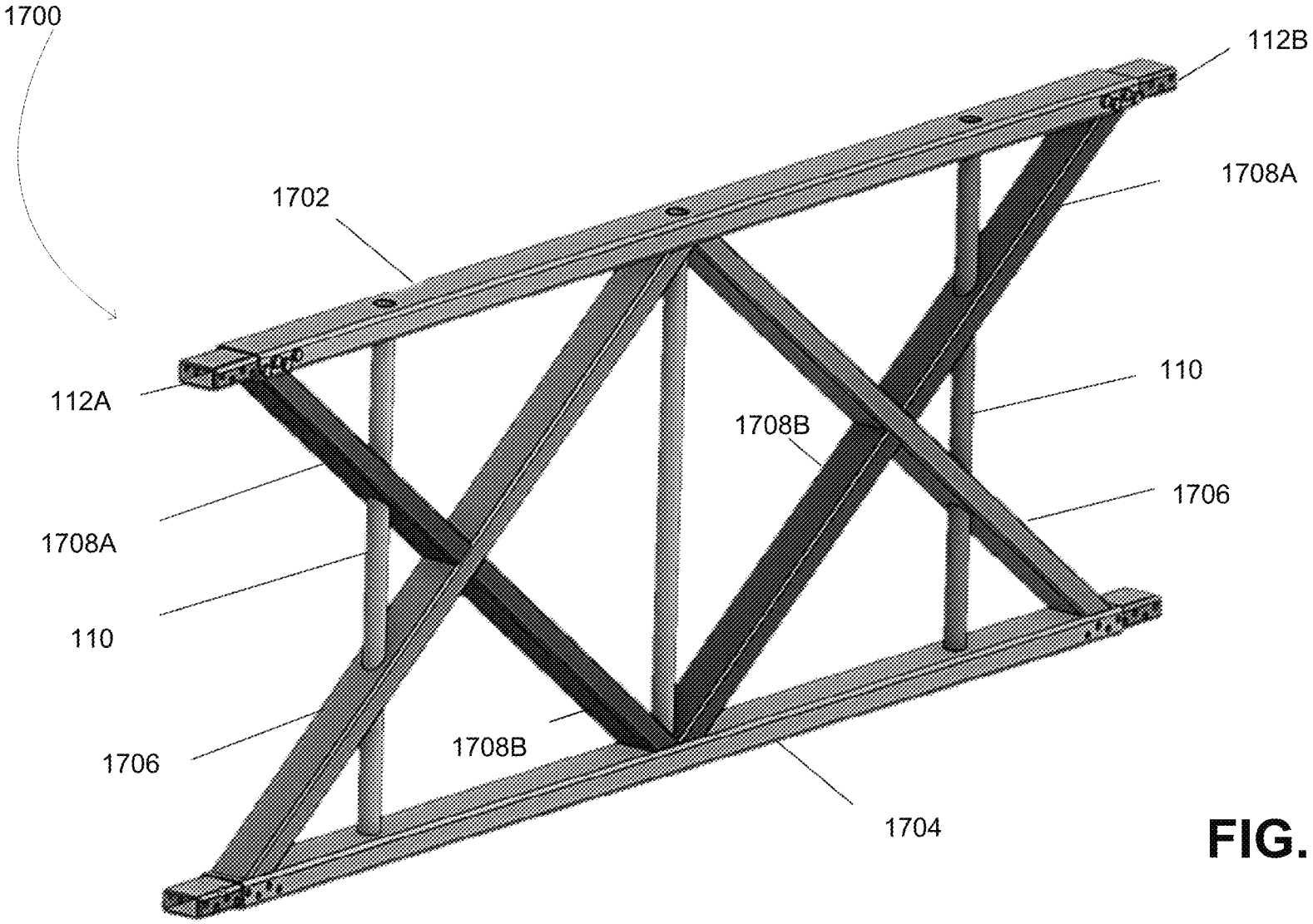
FIG. 17 is a front, perspective view of a third scaffold truss, in accordance with one example of the present application.

FIG. 17 illustrates a perspective view of a third scaffold truss 1700 in accordance with an example of the present application. The third scaffold truss 1700 is an example of an embodiment having a total length of 3 m. The third scaffold truss 1700 includes hollow, rectangular, upper horizontal member 1702 separated from hollow, rectangular, lower horizontal member 1704. Upper horizontal member 1702 is fixedly joined to lower horizontal member 1704 by diagonal bracing members 1706, 1708 and vertical member 110. Upper horizontal member 1702 and lower horizontal member 1704 have first and second ends having bolt holies oriented in a staggered position. The diagonal bracing member 1706 is a full diagonal bracing member, and the diagonal bracing member 1708 comprises two elements, 1708A and 170B. As shown, the diagonal bracing member elements 1708 and 170B are fixedly connected at the centre of diagonal bracing member 1706 to form an X-shape. In some embodiments, each of the diagonal bracing members 1706, 1708 are positioned such that they form an acute angle with one of the horizontal members 1702, 1704 of about 35-39 degrees. In some embodiments, the acute angle formed ranges from 37-38 degrees. In some embodiments, the acute angle formed is about 37.5 degrees and in at least one embodiment, the acute angle formed is 37.54 degrees. In some embodiments, the diagonal bracing member 1706 and diagonal bracing member elements 1708 and 170B are fixedly joined, for example, by welding, where they meet, at the upper horizontal member 1702 and at the lower horizontal member 1704. The fixed joining of these components may provide strength to the third scaffold truss 1700.

In some embodiments, the cross-sectional dimensions of the horizontal members of the second scaffold truss may be identical to the cross-sectional dimensions of the horizontal members of the first scaffold truss. In some embodiments, the cross-sectional dimensions of the diagonal bracing members of the second scaffold truss may be identical to the cross-sectional dimensions of the horizontal members of the first scaffold truss.

As shown in the example, three vertical members 110 is installed between the upper horizontal member 1702 and the lower horizontal member 1704 and through the diagonal bracing members 1706 and 1708. The diameter of the vertical members 110 is narrower than the lateral thickness of the upper horizontal member 1702 and the lower horizontal member 1704. The relative narrowness of vertical member 110 may provide for a profile that provides for space maximization when transporting and/or storing multiple trusses together, for example, within a storage container. In some embodiments, the diagonal bracing member 1706 and diagonal bracing member elements 1708 and 170B are fixedly joined, for example, by welding, where they meet, at the upper horizontal member 1702 and at the lower horizontal member 1704. The fixed joining of these components may provide strength to the third scaffold truss 1700.

In some embodiments, the vertical members 110 may be positioned at a fixed distance from one another, for example at a fixed distance of 1 m. In some embodiments, the vertical members 110 may be positioned at a distance from 0.5 m from one or both ends of the third scaffold truss 1700.

The third scaffold truss 1700 is shown having connectors, i.e., couplings 112A, 112B attached. As shown in FIG. 17, the couplings 112A and 112B may have bolt holes 114 oriented in a staggered position which compliment the pattern of the bolt holes in the upper and lower horizontal members 1702, 1704. In some embodiments, as shown, the third scaffold truss 1700 may be fixedly connected to the couplings 112A and 112B using bolts 116, which may be M16 bolts of grade 8.8.

Figure 18:
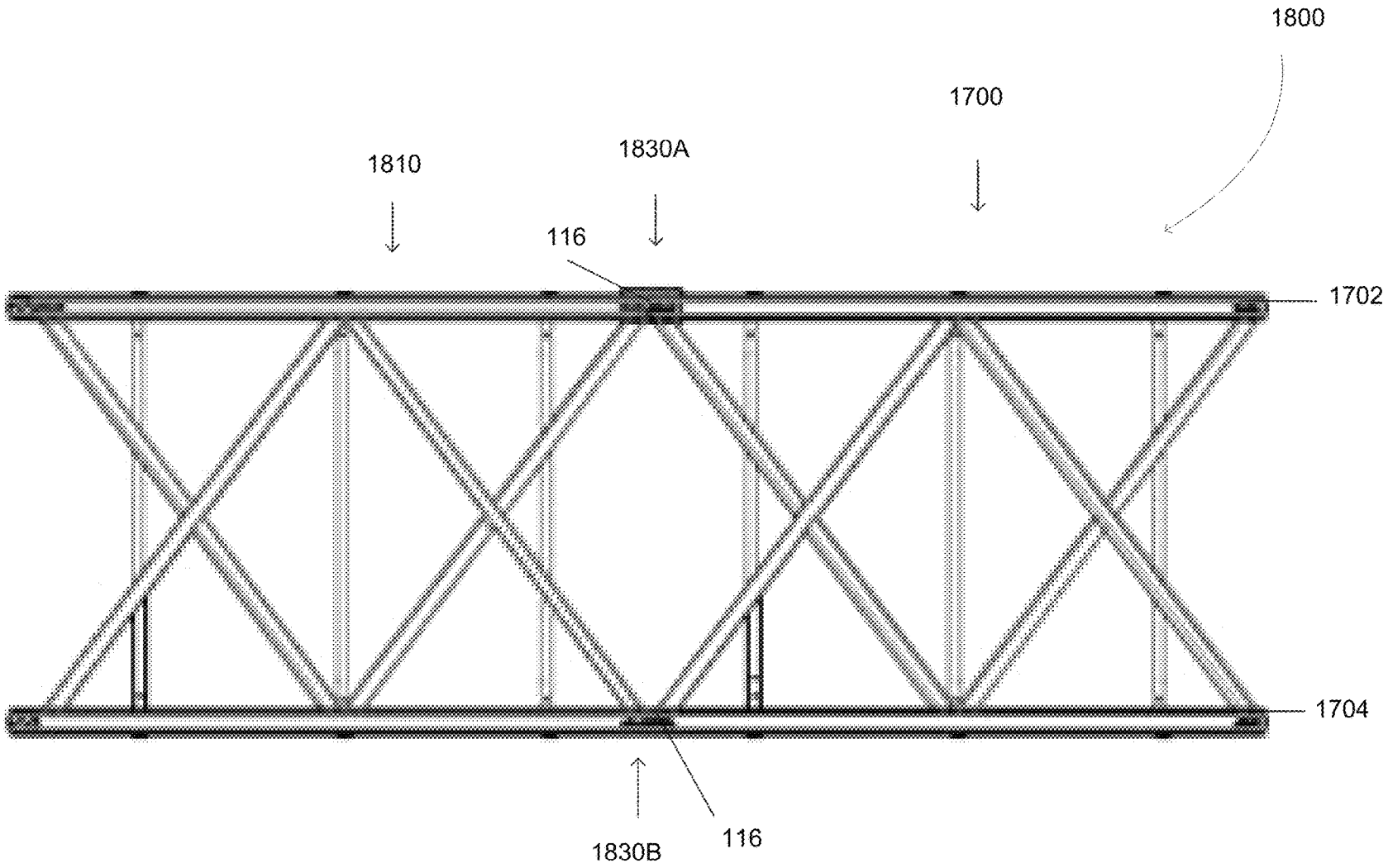
FIG. 18 is a front, perspective view of a third scaffold truss assembly, in accordance with one example of the present application.

FIG. 18 illustrates an example embodiment of a third scaffold truss assembly 1800. In this example, a third scaffold truss 1700 is fixedly connected to a third partner scaffold truss 1810 at connections 1830A and 1830B via couplings 112A and 112B (not shown). In some embodiments, the third partner scaffold truss 1810 may be identical to the third scaffold truss 1700. The coupling 112A is provided within a first end of the upper horizontal member 1702 of the third scaffold truss 1700 and is provided within a first end of the upper horizontal member of third partner scaffold truss 1810. The coupling 112B is provided within a first end of the lower horizontal member 1704 of the third scaffold truss 1700 and is provided within a first end of the lower horizontal member of third partner scaffold truss 1810. The couplings 112A and 112B are fixedly connected to the horizontal members using bolts 116, for example.

Figure 19:
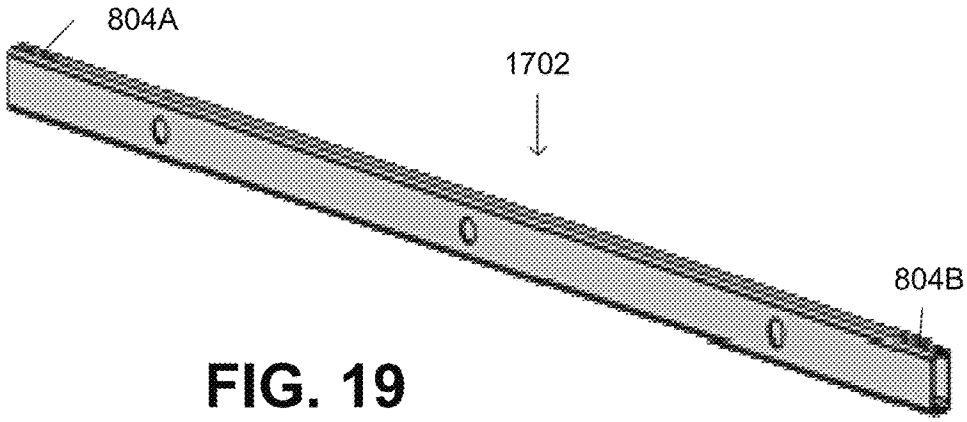
FIG. 19 is a top, perspective view of an upper horizontal bracing member of the third scaffold truss, in accordance with one example of the present application.

FIG. 19 illustrates a illustrates a top perspective view of upper horizontal member 1702, according to an embodiment. As shown in the example, upper horizontal member 1702 includes horizontal member bolt holes 804A, 804B at both ends and three openings 802 midway through the upper horizontal member 1702. In some embodiments, the openings 802 provides means for fixedly connecting with the vertical member 110. In some embodiments where the scaffold truss has a length of 3 m, the lower horizontal member 1704 has the same form as the upper horizontal member 1702.

Figure 20:
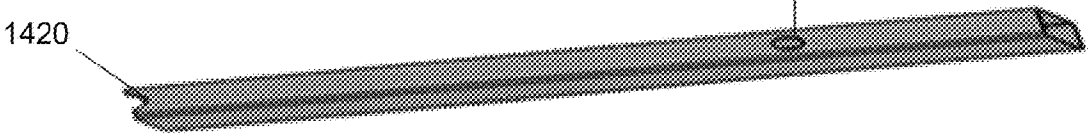
FIG. 20 is a perspective view of a first diagonal bracing member of the third scaffold truss, in accordance with one example of the present application.

FIG. 20 illustrates diagonal bracing member 1706 in accordance with an example of the present application. As illustrated, the diagonal bracing member 1706 has a vertical through hole 210 and a small notch 1420 to provide for the passage of one or more vertical members 110 in construction of the X-shapes shown in FIG. 17.

Figure 21:
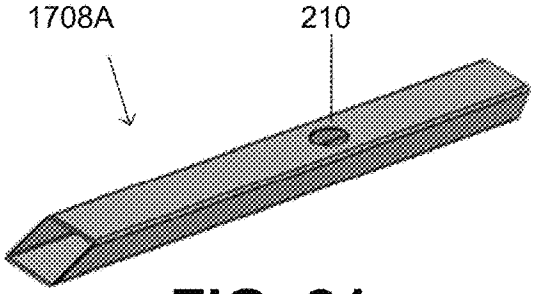
FIG. 21 is a perspective view of a first diagonal bracing member element of the third scaffold truss, in accordance with one example of the present application.

FIG. 21 illustrates diagonal bracing member element 1708 in accordance with an example of the present application. As shown in FIG. 17, the diagonal bracing member 1708 has two diagonal bracing member elements 1708 and 170B, which may be fixedly attached at the centre of diagonal bracing member 1706 to provide the X-shapes. The diagonal bracing member elements 1708, 170B may be fixedly attached to diagonal bracing member 1706 through welding, for example. Diagonal bracing member element 1708 includes vertical through hole 210.

Figure 22:
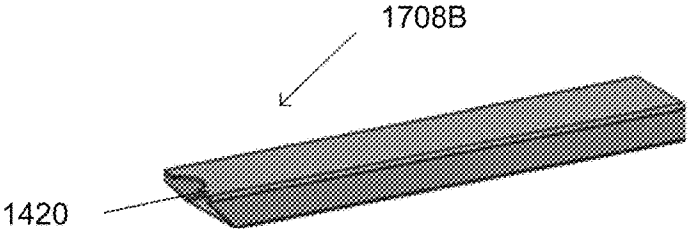
FIG. 22 is a perspective view of a second diagonal bracing member element of the third scaffold truss, in accordance with one example of the present application.

FIG. 22 illustrates diagonal bracing member element 170B. As shown, diagonal bracing member element 170B has a small notch 1420 to provide for the passage of vertical members 110 through the X-shape, as illustrated in FIG. 17.

Figure 23:
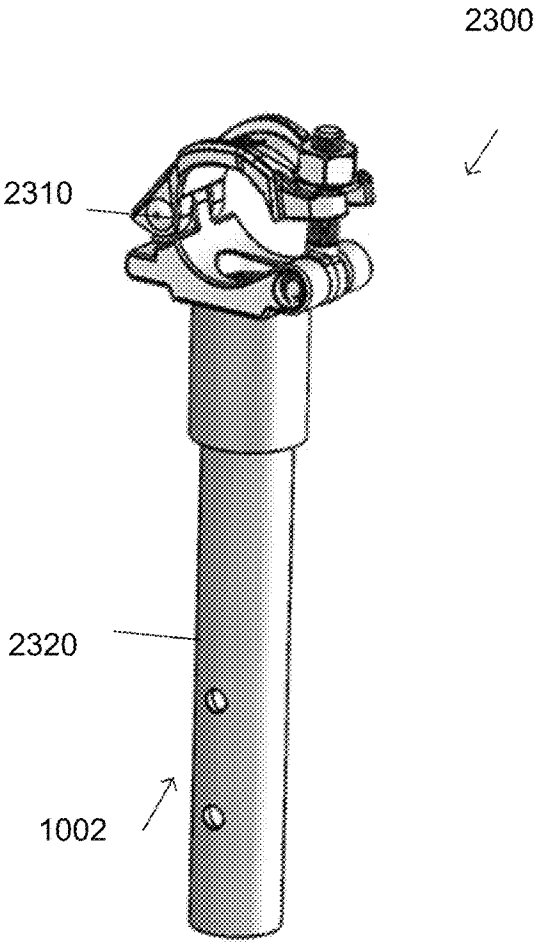
FIG. 23 is a spigot clamp, in accordance with one example of the present application.

FIG. 23 illustrates a spigot clamp 2300 in accordance with one example of the present application. As shown, the spigot clamp 2300 may comprise two elements: a spigot 2310 and a first clamp 2320. In some embodiments, the spigot clamp 2300 may be connected with a scaffold truss via vertical member 110 via the connection pin holes 1002.

Figure 24:
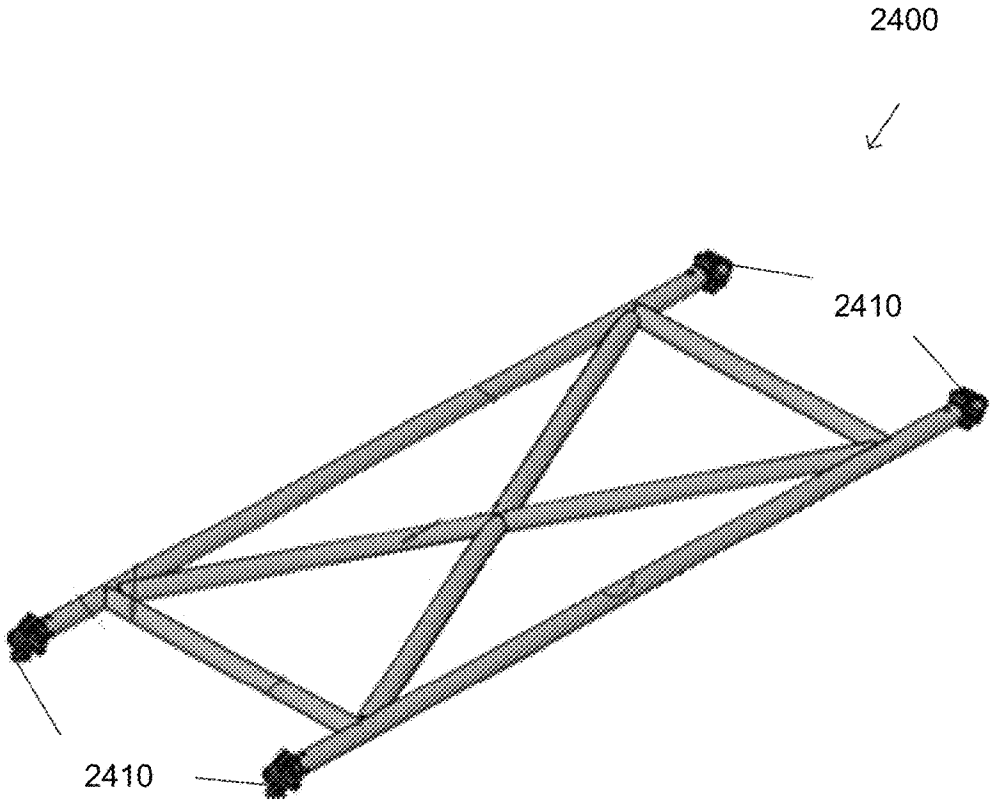
FIG. 24 is a brace frame, in accordance with one example of the present application.

FIG. 24 illustrates a brace frame 2400 in accordance with one example of the present application. As shown, the brace frame 2400 has second clamps 2420 at each of the four corners.

Figure 25:
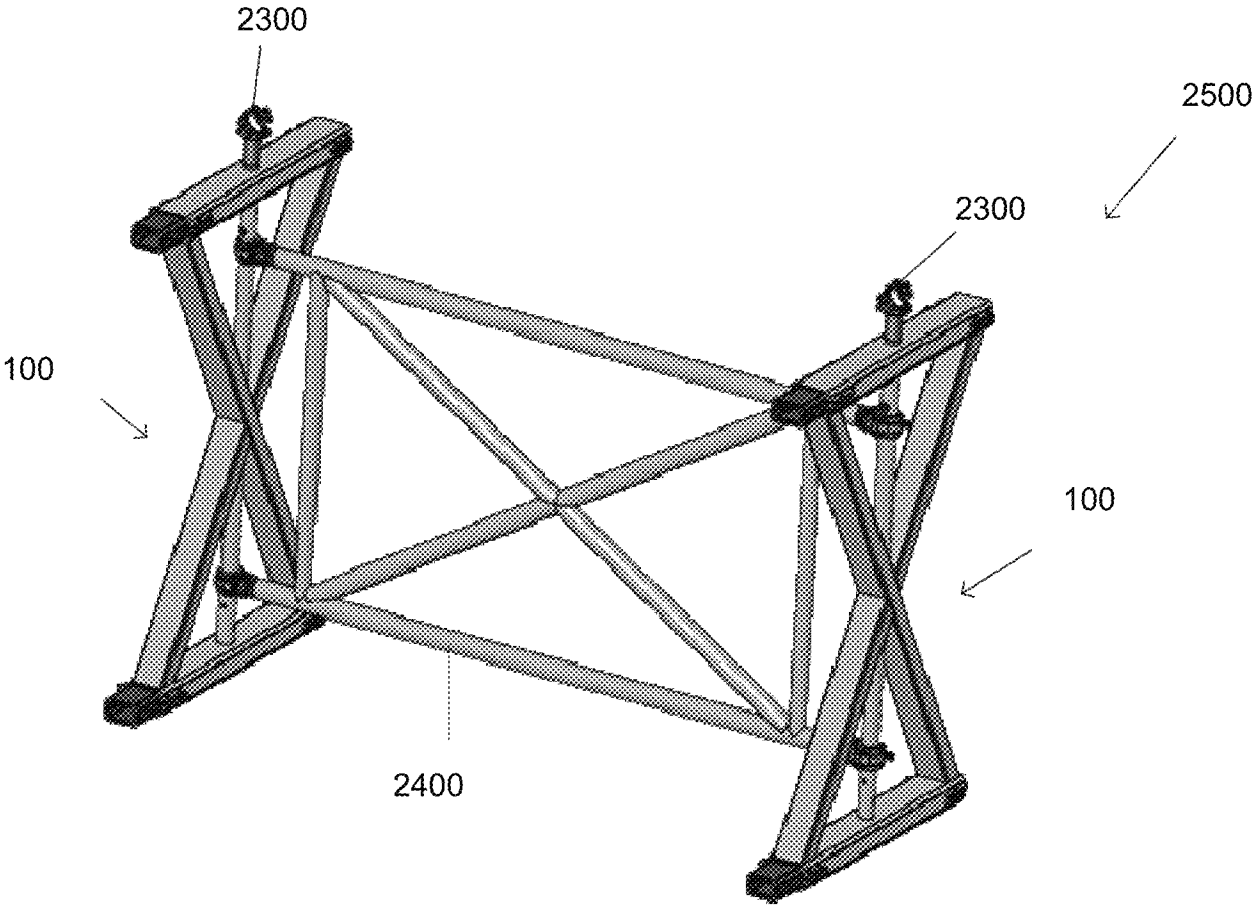
FIG. 25 is a fourth scaffold truss assembly, in accordance with one example of the present application.

FIG. 25 illustrates a fourth scaffold truss assembly 2500, in accordance with one example of the present application. As shown, two first scaffold trusses 100 are connected to a brace frame 2400 through attachment of the second clamps 2410 to the vertical members of the first scaffold trusses 100. A spigot clamp 2300 is shown extending from each of the two first scaffold trusses 100.

Figures 26, 27:
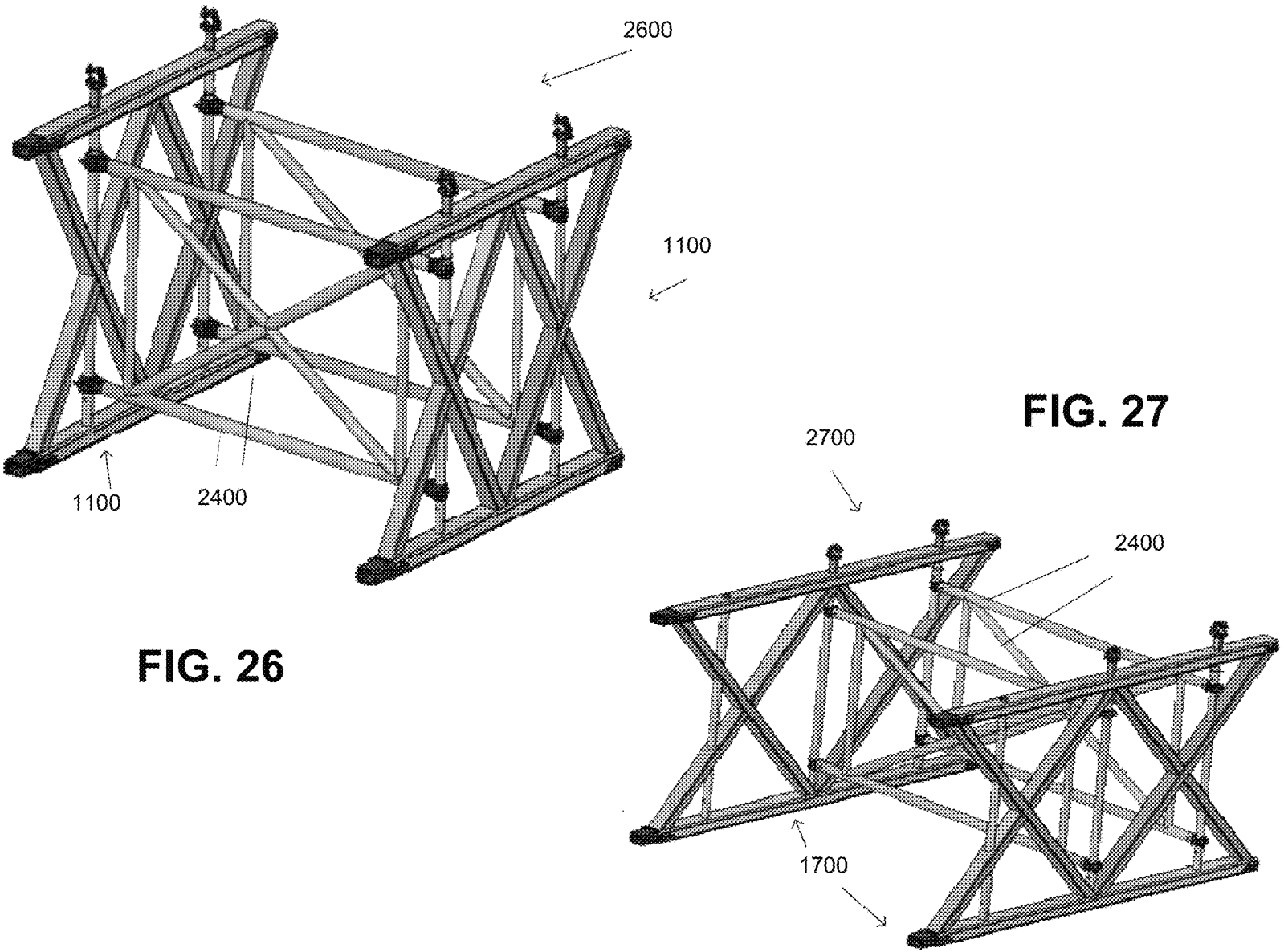
FIG. 26 is a fifth scaffold truss assembly, in accordance with one example of the present application.
FIG. 27 is a sixth scaffold truss assembly, in accordance with one example of the present application.

FIG. 26 shows a fifth scaffold truss assembly 2600, in accordance with one example of the present application. As shown, the fifth scaffold truss assembly 2600 resembles the fourth scaffold truss assembly 2500. The fifth scaffold truss assembly comprises two second scaffold trusses 1100 connected to two brace frames 2400.

FIG. 27 shows a sixth scaffold truss assembly 2700, in accordance with one example of the present application. As shown, the sixth scaffold truss assembly 2700 resembles the fourth and fifth scaffold truss assemblies 2500, 2600. The sixth scaffold truss assembly comprises two third scaffold trusses 1700 connected to two brace frames 2400.

The following tables provide an example of comparative test data illustrating that at least one embodiment of the present scaffold truss has improved load bearing capacity as compared with an example of the prior art.

TABLE 1

Load Capacity of Example Embodiment of the Present Application

| Span | m | 12 | 18 | 24 | 36 |
|---|---|---|---|---|---|
| Uniformly Distributed Load (UDL) | kN/m | 17.9 | 8.1 | 4.6 | 2.0 |
| Total UDL | kN | 215.3 | 145.0 | 109.6 | 73.8 |
| Single-Point Load (mid point) | kN | 110.0 | 73.0 | 54.6 | 36.3 |
| Two-point load | Each kN | 81.7 | 54.9 | 41.5 | 27.9 |
| Three-point load | Each kN | 54.9 | 36.4 | 27.2 | 18.1 |

TABLE 2

Load Capacity of 1500 mm Truss (X-Beam ™ from Apollo Scaffold Services)

| Span | | 12 | 18 | 24 | 36 |
|---|---|---|---|---|---|
| Uniformly Distributed Load (UDL) | kN/m | 16.0 | 7.4 | 4.1 | 21.8 |
| Total UDL | kN | 191.6 | 133.3 | 99.5 | 63.6 |
| Single-Point Load (mid point) | kN | 95.8 | 66.7 | 49.8 | 31.8 |
| Two-point load | Each kN | 71.9 | 50.0 | 37.3 | 23.8 |
| Three-point load | Each kN | 47.9 | 33.3 | 24.9 | 15.9 |

As noted, certain adaptations and modifications of the described embodiments can be made. Therefore, the above discussed embodiments are considered to be illustrative and not restrictive.

What is claimed is:

1. A scaffold truss comprising:

a hollow, rectangular upper horizontal member having vertical side walls and top and bottom walls;

a hollow, rectangular lower horizontal member having vertical side walls and top and bottom walls, the lower horizontal member being separated from the upper horizontal member;

a plurality of diagonal bracing members to fixedly join the upper horizontal member with the lower horizontal member, each of the plurality of diagonal bracing members forming an X-shape with another diagonal bracing member; and a plurality of vertical members to fixedly join the upper horizontal member with the lower horizontal member;

wherein a thickness of the vertical side walls of the horizontal members is greater than a thickness of the top and bottom walls of the horizontal members, and wherein the plurality vertical members are circular pipes having a diameter smaller than a lateral width of the diagonal bracing members, and wherein one or more of the plurality of vertical members pass through vertical through holes in the diagonal bracing members.

2. The scaffold truss of claim 1, wherein an outside corner radius of the horizontal members is greater than the thickness of the vertical side walls of the horizontal members.

3. The scaffold truss of claim 1, wherein an outside corner radius, the thickness of the top and bottom walls, and the thickness of the vertical side walls are unequal.

4. The scaffold truss of claim 3, wherein the thickness of the vertical side walls is 7 mm, the thickness of the top and bottom walls is 5 mm, and the outside corner radius is 10 mm.

5. The scaffold truss of claim 1, wherein the vertical members are fixedly joined to the upper horizontal member and to the lower horizontal member at a fixed spacing interval and wherein the fixed spacing interval the vertical members is less than a horizontal span of the X-shape.

6. The scaffold truss of claim 5, wherein the scaffold truss has first and second ends;

wherein the fixed spacing interval is 1 m; and wherein one of the vertical members is fixedly joined to the horizontal members at a distance of 0.5 m from a first end of the scaffold truss.

7. The scaffold truss of claim 1, wherein the diagonal bracing members are fixedly connected to one another.

8. The scaffold truss of claim 1, wherein the horizontal members and the plurality of diagonal bracing members are made of extruded aluminum and have engineered rectangular profiles.

9. The scaffold truss of claim 8 wherein the plurality of diagonal bracing members are fixedly joined to the upper horizontal member and to the lower horizontal member.

10. The scaffold truss of claim 1, wherein the plurality of diagonal bracing members are hollow, have equal wall thicknesses of 3 mm, have an inside radius of 3 mm and have an outside radius of 6 mm.

11. The scaffold truss of claim 1, wherein the plurality of diagonal bracing members are fixedly joined to the upper horizontal member and to the lower horizontal member at an acute angle of about 35 degrees to 39 degrees.

12. The scaffold truss of claim 1, wherein the vertical members have first and second ends, the first and second ends being configured to removably connect with a spigot clamp.

13. The scaffold truss of claim 1, wherein the horizontal members have first and second ends, the first and second ends being configured to removably connect with a coupling.

14. The scaffold truss of claim 13, wherein the upper horizontal member and the lower horizontal member have first and second ends having bolt holes positioned in a staggered pattern.

15. The scaffold truss of claim 1, wherein the horizontal members have a length selected from the group consisting of 1 m, 3 m and 5 m.

16. The scaffold truss of claim 1, wherein the vertical members are hollow and have a wall thickness of 2.5 mm.

* * * * *